United States Patent [19]

Power

[11] 4,208,821

[45] Jun. 24, 1980

[54] VARIABLE RANGE SIGHT

[75] Inventor: Ronald W. Power, Independence, Mo.

[73] Assignee: Power Custom, Inc., Independence, Mo.

[21] Appl. No.: 963,188

[22] Filed: Nov. 24, 1978

[51] Int. Cl.[2] ..... F41G 1/28

[52] U.S. Cl. ..... 42/1 S; 33/254; 33/260

[58] Field of Search ..... 42/1 S, 1 SR; 33/254, 33/257, 252, 259, 260

[56] References Cited

U.S. PATENT DOCUMENTS

| | | | |
|---|---|---|---|
| 2,112,268 | 3/1938 | Burton | 42/1 S |
| 3,495,339 | 2/1970 | Elliason | 42/1 S |
| 4,127,943 | 12/1978 | Tiritilli | 42/1 S |

FOREIGN PATENT DOCUMENTS

| | | | |
|---|---|---|---|
| 116152 | 4/1946 | Sweden | 33/252 |
| 140557 | 5/1953 | Sweden | 33/254 |
| 952372 | 3/1964 | United Kingdom | 33/254 |

OTHER PUBLICATIONS

*Police Marksman*, pp. 6 and 19, Winter, 1977.

Aristcrat Gunsight Co., advertisements; 8/28/78.

Cake Davis Co., Custom Gunsight Instructions, 8/28/78.

*Primary Examiner*—Charles T. Jordan

*Attorney, Agent, or Firm*—D. A. N. Chase; Michael Yakimo, Jr.

[57] ABSTRACT

A sighting device for aiming a firearm, particularly handguns, employs a rib upon which a rear sight leaf is pivotally mounted. Attached to the leaf is a plurality of downwardly projecting elevation screws terminating at selectively adjustable and predetermined distances from the leaf. A finger-operated elevation wheel beneath the screws has an upwardly facing elevation ramp therein which is rotatable about a vertical axis (assuming that the firearm is held in a normal firing position) to any one of a plurality of angular positions. Rotation of the wheel towards a selected position concurrently rotates the elevation ramp into initial sliding engagement with an overlying elevation screw. Subsequent seating of the elevation screw in a recess on the ramp sets the elevation of the sight leaf. An indicator on the wheel indicates to the shooter which screw is seated and, thus, which sight elevation is in use.

14 Claims, 12 Drawing Figures

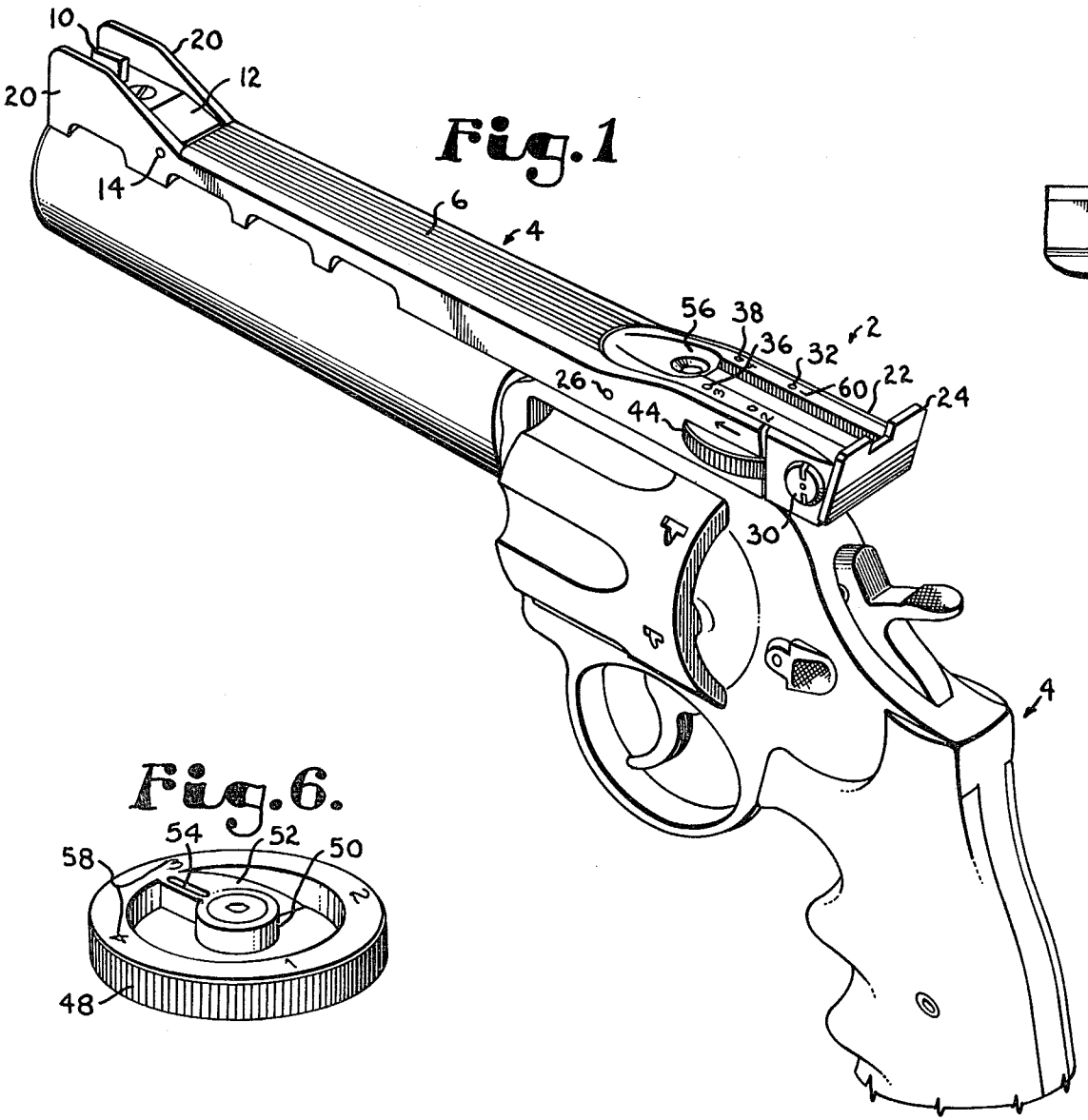
Fig. 1
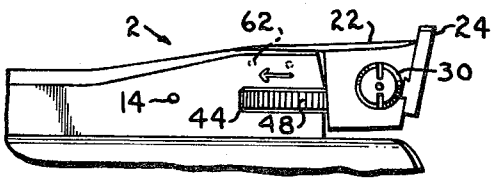
Fig. 3.
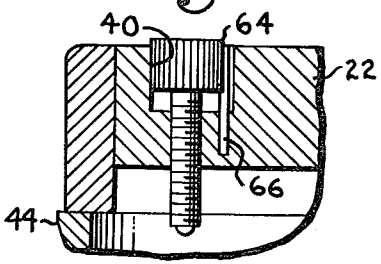
Fig. 12.
Fig. 6.

VARIABLE RANGE SIGHT

BACKGROUND OF THE INVENTION

This invention relates to an adjustable sight for a firearm and, more particularly, to improvements in such sights which enable a shooter to accurately position with fingertip control the elevation of a rear sight over a range of predetermined elevations thereof.

In competitive pistol shooting, targets are presented to the shooter at various ranges to test the shooter's ability to hit the bull's-eye or X-ring of each target. Due to the differences in target distance it is necessary to adjust the angle of bullet trajectory by adjusting the inclination of the gun barrel before firing. Gun sighting devices have addressed this adjustment by introducing the capability to variously adjust the elevation of the rear sight in response to different target distances.

Sighting devices in use employ different means to adjust a rear sight leaf so as to correspondingly adjust the elevation of an attached rear sight. One such means in use employs a horizontally disposed cam member laterally placed across a sight rib so as to functionally engage elevation screws attached to an overlying sight leaf. The necessity to laterally align the elevation screws for engagement with the underlying cam limits the number and range of elevations available to the rear sight, as dictated by the width of the sight leaf itself. Also, a structural weakness to the leaf across the line of alignment is introduced which, in some cases, leads to a break in the sight leaf itself.

Another sight rib in use consists of a vertically disposed screw rotatable about its own axis, which raises or lowers the attached leaf and sight mounted thereto in a jackscrew type of manner. This particular configuration requires the shooter to count and record the number of screw turns thus, necessitating the shooter himself to keep careful track of the screw position, lending itself to critical inaccuracies in the sight adjustment. In such a device there is no positive control available to the shooter to instantly recall previously selected sight positions.

In both cases it is necessary to use a screwdriver, allen wrench or other similar tool to actuate the employed means which is relatively cumbersome, annoying and tends to distract the shooter's concentration from the firing situation at hand.

SUMMARY OF THE INVENTION

In the practice of the invention an elongated rib is mounted atop a handgun. A rear sight leaf with a rear sight attached at one end thereof, is pivotally mounted to the rib about a pin member laterally extending through the rib adjacent to the rear end thereof. A plurality of vertically disposed elevation screws project downwardly through the rear leaf, each screw having a lower free end terminating at preselected and adjustable distances from the overlying sight leaf. Located underneath the screw array is an elevation wheel rotatable about an axle downwardly projecting through the rib. Upon the wheel is an arcuate elevation ramp designed to engage a free end of an overlying screw in a recessed ramp seat thereon. As the elevation wheel is digitally rotated by the shooter, the elevation ramp initially engages an overlying screw free end. Subsequent rotation of the wheel causes the underlying ramp to present to the screw a ramp recess, so that the screw end seats itself therein. The concurrent elevation of the attached sight leaf presents to the shooter a new rear sight elevation. Ramp seating of an elevation screw is apparent to the shooter by tactile feedback as well as, by visual means on the wheel indicating to the shooter the particular elevation screw seated therein.

The preselected distances of the screw free ends from the sight leaf are determined by "sighting in" the handgun at various targets as each screw is in a ramp seated position. Adjustments, varying the projection of each ramp seated screw, result in a concurrent elevational adjustment to the rear sight which corresponds to particular firing situations, such as the distance of the target from the shooter. Thus, in subsequent firings, the shooter, when presented with a particular target situation as previously "sighted in," can rotate the elevation wheel to seat that particular screw.

The concurrent adjustment of the rear sight elevation assures that proper alignment of the front and rear sights will produce results previously achieved during the "sighting in" process.

It is, therefore, a primary object of this invention to provide a gun sight device designed to give a shooter the ability to manually set a gun sight to an elevation available for recall from a plurality of preselected gun sight elevations.

It is, also, an important object of this invention to provide in a gun sight device, as aforesaid, an elevation control associated with a gun sight which acts as a memory in which to store the preselected gun sight elevations.

Another important object of this invention is to provide such a device which is responsive to and actuated by fingertip control.

Still, another important object of this invention is to provide such a gun sight device which is inexpensive and simple to manufacture, structurally sound in design and efficient in use.

A more particular object of this invention, is to provide such a device, as aforesaid, which provides feedback to the shooter indicating that a preselected sight elevation has been placed into use.

Still, a more specific object of this invention is to provide such a device which indicates to the shooter the particular sight elevation currently in use.

Other objects and advantages will become apparent from the following description taken in connection with the accompanying drawings wherein a preferred embodiment of the invention is set forth by way of illustration and example.

DESCRIPTION OF THE DRAWINGS

FIG. 1 is a perspective view showing a firearm with the variable range sight in use with a sight rib mounted on a handgun.

FIG. 3 is a fragmentary side elevation view showing the rear sight in an elevated position.

FIG. 6 is a perspective view, on an enlarged scale, showing the elevation wheel.

FIG. 12 is a fragmentary sectional view, on an enlarged scale, showing an alternative elevation screw embodiment as positioned in the sight leaf.

DESCRIPTION OF THE PREFERRED EMBODIMENT

Figure 2:
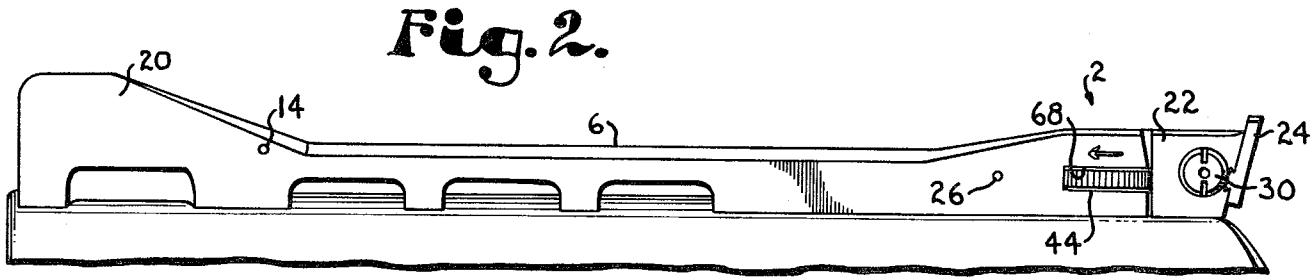
FIG. 2 is a side elevation view of the sight rib with the variable range sight mounted thereto.
Figure 4:
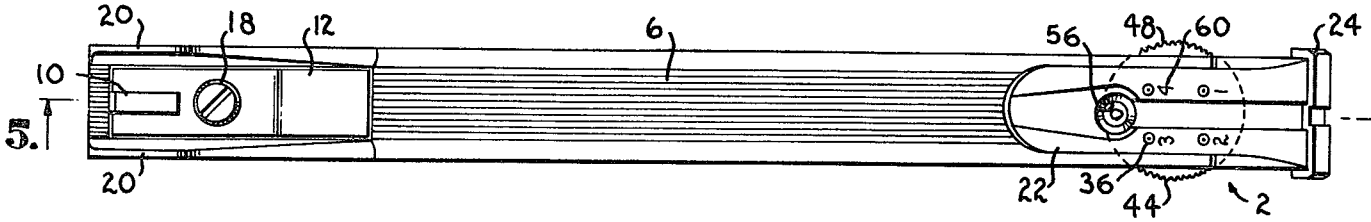
FIG. 4 is a top planar view of the sight rib with the variable range sight mounted thereto.
Figure 5:
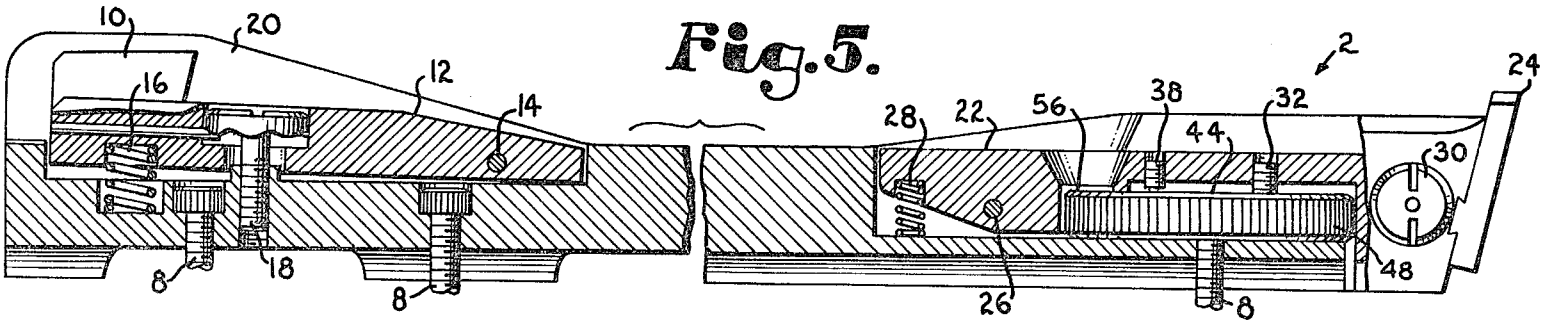
FIG. 5 is a longitudinal sectional view taken along line 5—5 in FIG. 4.
Figure 8:
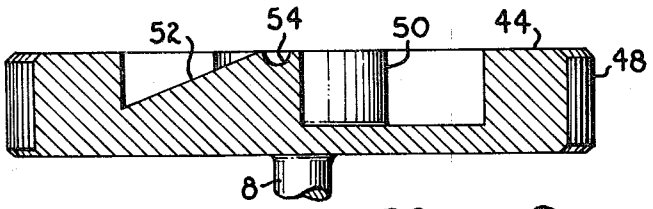
FIG. 8 is a side sectional view taken along line 8—8 in FIG. 7.

Referring to the drawings in more detail, the variable sight device 2 comprises an elongate rib member 6 mounted longitudinally atop a handgun 4 by means of mounting screws 8 spaced along the rib 6. Located towards the forward end of the rib 6 is a front sight 10 on a front sight leaf 12. The front sight leaf 12 is pivotally mounted to the rib 6 in up-and-down movement about a pin member 14, which laterally extends through the rib and sight leaf 12 at a longitudinally displaced position from the rib front end. Underlying the forward end of the front sight leaf 12 is a spring 16 for biasing the leaf 12 into clockwise movement about the front pin member 14. A vertically disposed screw 18 bridging the leaf 12 and underlying rib 6 is vertically adjustable so as to raise or lower the front sight leaf 12 and front sight 10 attached thereto. Front sight guards 20 are located along the forward sides of the rib 6 and serve as protection to the front sight 10 itself.

A rear sight leaf 22 having a rear sight blade 24 attached at the end thereof is pivotally mounted to the rib 6 in up-and-down movement about a pin member 26 which laterally extends through the rib 6 and rear sight leaf 22 at a longitudinally displaced position from the rear end of the rib 6. Underlying the forward end of the rear sight leaf 22 is a spring 28 urging the leaf into clockwise movement about the pin member 26. The rear sight and associated windage screw 30 extends beyond the rib member 6 when the rear sight leaf 22 is in a mounted position.

An array of screws 32, 34, 36 and 38, functionally called elevation screws, are inserted through threaded bores 40 on the rear sight leaf 22 and are functionally rotatable therein by an allen wrench, screwdriver or other compatible tool. The elevation screws 32, 34, 36 and 38 are preferably identical in length and are variously adjusted so as to have the respective screw free ends 42 terminating at selected distances from the overlying leaf 22, the method of pre-selection to be subsequently discussed. Abutting each elevation screw at a right angle is a set screw 62 designed to prevent elevation screw slippage during weapon fire.

Another embodiment of the elevation screw is shown in FIG. 12, in which a vertically disposed pin 66, located in the bore 40, is used instead of the set screw 62. The elevation screw 64 has a knurled head abutting the pin 66 so that as the screw is turned, perceptible clicks are offered to the shooter. The shooter can relate these clicks to the upward or downward movement of the screw 64 resulting from the screw rotation.

Positioned underneath the screw array is a generally horizontally disposed wheel 44, functionally called an elevation wheel 44, rotatable about a wheel axle 46. The wheel 44 is easily slidable into a slot 68 located at the rear of the rib so that the wheel hub 50 encompasses the head of the rear mounting screw 8 and is rotatable thereabout. This manner of mounting restricts wheel movement to rotation about the wheel center in a fixed plane thereto. The wheel 44 has a knurled rim 48, allowing for easy fingertip rotation of the wheel 44. Located within the wheel 44 is an arcuate elevation ramp 52 rising to the height of the wheel rim 48, throughout its limited counter-clockwise progression about the wheel hub 50. At the top of the ramp 52, a ramp recess 54 is inserted for use as a seat for the elevation screw free ends 42.

Figure 10:
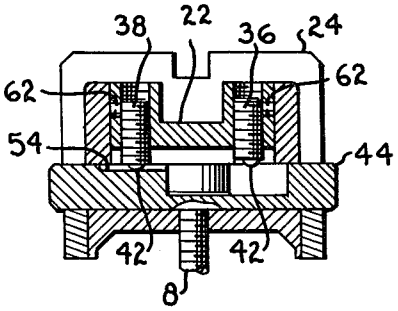
FIG. 10 is a sectional view taken along line 10—10 in FIG. 9 showing a ramp-engaged elevation screw.
Figure 11:
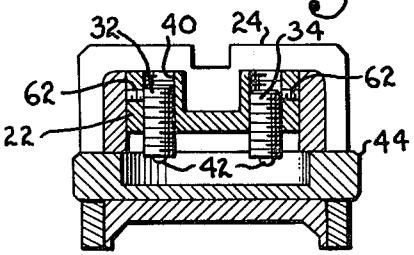
FIG. 11 is a sectional view taken along line 11—11 in FIG. 9 showing elevation screws in a disengaged position.
Figure 7:
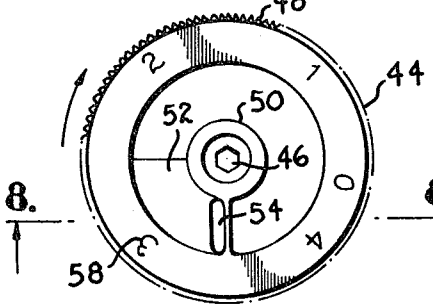
FIG. 7 is a top planar view, on an enlarged scale, of the elevation wheel.
Figure 9:
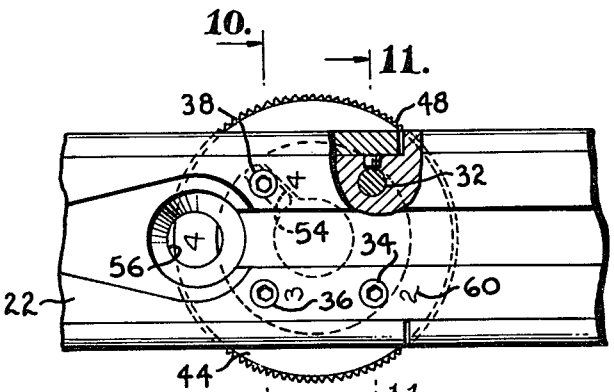
FIG. 9 is a fragmentary view, on an enlarged scale, showing the elevation wheel in a functional position.

As shown in FIGS. 10 and 11, each elevation screw projects below the free edge of the wheel rim 48. Thus, as the wheel is rotated by the thumb or finger of the shooter in a clockwise manner, the elevation ramp 52 initially engages a screw free end 42 at some point on the ramp depending on the distance of the screw free end 42 from the overlying rear sight leaf 22. It is here noted that the arc length of the elevation ramp 52 and/or the relative placement of each elevation screw in the screw array are chosen so as to allow only one elevation screw/ramp engagement at a time. During subsequent wheel 44 rotation, the respective elevation screw being in contact with the elevation ramp 52 surface slides into the ramp recess 54 and is seated therein, the occurence of which is tactilely perceptible to the shooter at that instant. Indicia 58 on the wheel 44, corresponding to indicia 60 on the top surface of the rear sight leaf 22 are individually visible to the shooter through a face 56 on the rear sight leaf 22 which indicates to the shooter the particular elevation screw 32, 34, 36 or 38 currently in a ramp-seated position. The bias by the spring 28 on the forward end of the rear sight leaf 22 assists in the maintenance of the respective screw in its ramp-seated position. This bias is overcome by fingertip pressure sufficient to rotate the wheel 44, which causes the elevation screw to unseat as the elevation ramp 52 initially continues in its clockwise path for subsequent approach to the next elevation screw on its circular path. Thus, it can be seen that the circular path enables the elevation screws 32, 34, 36 and 38 to be circumferentially positioned and, thus, avoids the problems caused by requirement of lateral screw alignment.

Due to pivotal mounting of the rear leaf 22 and attachment of the elevation screws 32, 34, 36 and 38 thereto, the individual engagement of each screw on the ramp 52 and subsequently seating in the recess 54 thereon results in a concurrent lifting of the rear sight leaf 22 and blade 24 attached thereto. Thus, the ultimate relative change in rear sight elevation corresponds to the relative differences in the lengths of projection of the individual elevation screws from the overlying sight leaf 22.

Although the embodiment has been disclosed in relation to a sight rib, it can be seen that the rear sight leaf 22, elevation screws 32, 34, 36 and 38 and elevation wheel 44 combination, acts in concert as a rear sight elevation control unit which can be used as an integral part of a weapon, if so desired, and need not be associated with a rib member 6 as disclosed in the heretofore description of the preferred embodiment.

OPERATION

For purposes of illustration and use and not limitation, assume that the shooter is faced with targets at ranges of 7, 25, 50 and 100 yards respectively. The above variable range sight, as heretofore described can be used in the following manner:

1. If the shooter wishes, each elevation screw 32, 34, 36 and 38 can be turned so that the screw head is at a medial position relevant to the length of the bore 40 allowing an equal range of vertical up-and-down adjustment of each screw.
2. The shooter then turns the elevation wheel 44 until the first screw 32 is in a ramp-seated position as indicated by the "1" visible on the rear sight leaf face 56.
3. The shooter can then "sight in" at the 7 yard target in a conventional firing manner. Vertical adjustment of the seated screw 32 is made by an allen wrench which raises or lowers the rear sight so that the desired shot grouping can be achieved on the target. Once achieved, the wheel 44 is rotated to seat another elevation screw. In the alternative elevation screw embodiment shown in FIG. 12, the elevation screw 64 can be adjusted according to the number of clicks as perceived by the shooter. The experienced shooter familiar with his weapon will know the number of clicks needed to raise or lower a shot grouping at at a particular target distance, thus, shortening the "sighting in" process. Appropriate windage adjustment by means of the windage screw 30 can also now be determined.
4. The shooter then turns the elevation wheel 44 until the second screw 34 is in a ramp-seated position as indicated by the number "2" visible on the rear sight leaf face 56. Step three as performed for screw "1" can then be repeated at the 25 yard target in a similar manner.
5. The "3" and "4" screws, 36 and 38, can be adjusted, as described above, for the 75 and 100 yard targets.
6. Once the elevation screws have been so adjusted the shooter is ready for firing. When faced with a target situation as previously "sighted in" the shooter can simply turn the wheel 44 by means of fingertip control until the appropriate elevation screw 32, 34, 36 and 38 is seated on the elevation ramp 52 with assurance that the rear sight 24 is now at a proper "sighted in" elevation.

Having thus described the invention, what is claimed as new and desired to be secured by Letters Patent is:

1. In a gun having a sight on an adjustable leaf, the improvement comprising:

an elevation control having first and second selectively operable components associated with said leaf for raising or lowering the leaf to selectively elevate the sight, means for mounting said control on said gun with said components disposed one above the other, said first component comprising an elevation wheel for setting the sight at any one of a plurality of incremental elevations thereof, said wheel being rotatable about a generally vertical axis when the gun is held in a normal firing position, said wheel having a plurality of angularly spaced, selectable positions corresponding to said plurality of incremental elevations of said sight, said second component comprising a plurality of selectable elevation control elements angularly spaced about the axis of said wheel for supporting said leaf at any one of said plurality of incremental elevations of the sight, each of said elements corresponding to a different one of said positions of the wheel and cooperating therewith to support the sight at the desired elevation when the wheel is in the corresponding selected position, whereby to control the elevation of the sight over a range of said incremental elevations thereof.

2. The improvement as claimed in claim 1, wherein:

each elevation control element terminates at a selectable distance from said leaf, said distance corresponds to said desired sight elevation.

3. The improvement as claimed in claim 1, wherein:

each elevation control element is a screw, each screw of a determinate length corresponding to said sight elevation over a range of elevations thereof.

4. The improvement as claimed in claim 3, wherein:

said elevation screw is rotatable about the screw axis to vary said screw length so as to adjust said corresponding sight elevation.

5. The improvement as claimed in claim 4, further comprising:

means to prevent slippage of said elevation screws, said means including horizontally disposed setscrews abutting each respective elevation screw at a generally right angle thereto.

6. The improvement in claim 4, further comprising:

said elevation screw has a knurled head located at the top thereof, p1 a vertically disposed pin member abutting said knurled head therealong, whereby said pin abutment indicates the degree of screw rotation during adjustment thereto, as well as prevents slippage of said elevation screw.

7. The improvement as claimed in claim 1, wherein:

said elevation control elements extend from said leaf overlying said wheel, each element terminating at a selectable distance from said leaf corresponding to a desired sight elevation, said wheel engages said corresponding element when said wheel is rotated to said selected position, whereby said leaf is responsive to said engagement so as to adjust the elevation of said sight attached thereto.

8. The improvement as claimed in claim 1, further comprising:

means in said elevation control for registering said elevation control element and said wheel for said cooperation, said registration means includes a surface disposed towards said elevation control elements, said surface engaging said corresponding elevation control element when said wheel is in said corresponding selected position.

9. In a gun having a sight on an adjustable leaf, the improvement comprising:

an elevation control having first and second selectively operable components associated with said leaf for raising or lowering the leaf to selectively elevate the sight, means for mounting said control on said gun, said first component comprising an elevation wheel beneath said leaf for setting the sight at any one of a plurality of incremental elevations thereof, said wheel being rotatable about a generally vertical axis when the gun is held in a normal firing position, said wheel having a plurality of angularly spaced, selectable positions corresponding to said plurality of incremental elevations of said sight, said second component comprising a plurality of selectable elevation control elements on said leaf angularly spaced about the axis of said wheel and projecting toward the wheel for supporting said leaf at any one of said plurality of incremental elevations of the sight, each of said elements corresponding to a different one of said positions of the wheel, said wheel having means thereon responsive to rotation of the wheel for registering a selected element thereon to support the sight at the desired elevation when the wheel is in the corresponding selected position, whereby to control the elevation of the sight over a range of said incremental elevations thereof.

10. The improvement as claimed in claim 9, wherein:

said wheel means comprises a surface associated with said wheel, said surface disposed toward said elevation control elements, said surface engages said corresponding elevation control element when said wheel is in said corresponding selected position.

11. The improvement as claimed in claim 9, wherein:

said wheel means comprises a ramp member mounted to said wheel, said ramp member having an inclined surface disposed toward said elevation control elements, said surface engages said corresponding elevation control element when said wheel is in said corresponding selected position.

12. The improvement as claimed in claims 10 or 11, wherein:

said surface has a recess thereon for seating said engaged elevation control element therein.

13. The improvement as claimed in claim 11, wherein:

said ramp member is arcuate in configuration about the center of said wheel.

14. The improvement as claimed in claim 11, wherein:

said ramp is determinate in length so as to singularly engage elevation control elements during said wheel rotation.

* * * * *